US005878903A

United States Patent [19]

Ung

[11] Patent Number: 5,878,903

[45] Date of Patent: Mar. 9, 1999

[54] EXTENSIBLE AND EXTRACTABLE CARGO CONTAINER

[76] Inventor: Lu-Hsiung Ung, F1. 2, No. 5, Lane 3, Hsing Tong St., Taipei, Taiwan

[21] Appl. No.: 919,045

[22] Filed: Aug. 27, 1997

[30] Foreign Application Priority Data

Aug. 28, 1996 [TW] Taiwan ..... 85213226

[51] Int. Cl.[6] ..... B65D 6/16

[52] U.S. Cl. ..... 220/8; 220/1.5; 220/666; 222/181.1; 222/95

[58] Field of Search ..... 220/1.5, 8, 4.03, 220/666, 1.6, 495.01, 601, 680, 720, 723; 222/181.1, 185.1, 93, 95

[56] References Cited

U.S. PATENT DOCUMENTS

| | | | |
|---|---|---|---|
| 833,594 | 10/1906 | Froman et al. | 222/181.1 |
| 2,701,667 | 2/1955 | Shipp | 222/93 |
| 4,020,975 | 5/1977 | Stauffer | 222/93 |
| 4,449,724 | 5/1984 | Ahn | 220/8 |
| 4,724,976 | 2/1988 | Lee | 220/8 |
| 5,673,360 | 9/1997 | Scripps | 220/8 |
| 5,699,935 | 12/1997 | Stahley | 222/94 |
| 5,782,372 | 7/1998 | Weiss et al. | 220/8 |

*Primary Examiner*—Stephen Castellano
*Attorney, Agent, or Firm*—Bucknam and Archer

[57] ABSTRACT

A extensible and retractable cargo container, comprises a top portion, a middle portion and a lower portion sleeve jointed together with each other, and further comprises a plurality set of block mechanisms for holding the top portion, the middle portion and the lower portion set in an extensible status, and a plurality of buffer rods for buffering the weight from the top portion, the middle portion and the top portion during retracting.

4 Claims, 4 Drawing Sheets

EXTENSIBLE AND EXTRACTABLE CARGO CONTAINER

BACKGROUND OF THE INVENTION

1. Field of the Invention

The present invention generally relates to an extensible and retractable structure of a cargo container for extending and retracting side walls of the cargo container which is ready for loading cargos in the extended position, and is ready for storage in the retracted position.

2. Description of Prior Art

In the past, there are many disclosure of cargo containers which can be taken apart and reassembled. The side walls being taken apart from this kind of cargo container can be separately stocked up together for reducing the overall dimension of the returned empty cargo containers. Therefore, it decreases the shipping costs owing to greatly increasing the numbers of empty cargo containers transported.

However, this kind of structure of the cargo container which has separable side walls is not easy to be dismantled and reassembled. In fact, the size, the length and the weight of the dismantled side walls which assembles the cargo container are very large. It require several workers working together to complete these tasks. It is a common drawbacks and disadvantage of this kind of cargo container due to their time consuming in dismantling and reassembling.

SUMMARY OF THE INVENTION

In view of the disadvantage mentioned above, a new type of cargo container structure which can be extensible and retractable is provided by the inventor. The body of the container comprises of three portions which are restricted not separating by each other to form into one single unit together and are able to slide relative to each other. Such a structure can be lifted up by an external force, and these three portions then can be slided relative to each other until it is extended. Therein pins can be inserted into the adjacent interfaces of these portions to hold the extended from for receiving cargos. In a reversed procedure, these three portions then can be slided automatically to close down by the weights of the higher portions of the cargo container when the pins are pulled out. The dimension will be reduced to one third of its normal size and storage capability is enhanced.

Accordingly, it is an object of this invention using the extensible and retractable cargo container structure provided by the present invention which may not necessary be required the man power and time to dismantle the cargo container and reassemble it as a conventional cargo container does. It is only necessary to use a fixed crane equipment in a container storage yard to complete rapidly the retraction and re-extension of the cargo container. It is very convenient to utilize this type of cargo container.

The further object of the present invention is that the structure of this extensible and retractable cargo container is completed by machinery in achieving the tasks of extension and retraction according to the present invention. The process of the tasks are then can be quickened.

In order to further understand substantially the object and advantage of the present invention. It will become evident from following detailed explanation in conjunction with the accompanied drawings.

DETAILED DESCRIPTION OF THE PREFERRED EMBODIMENT

Figure 1:
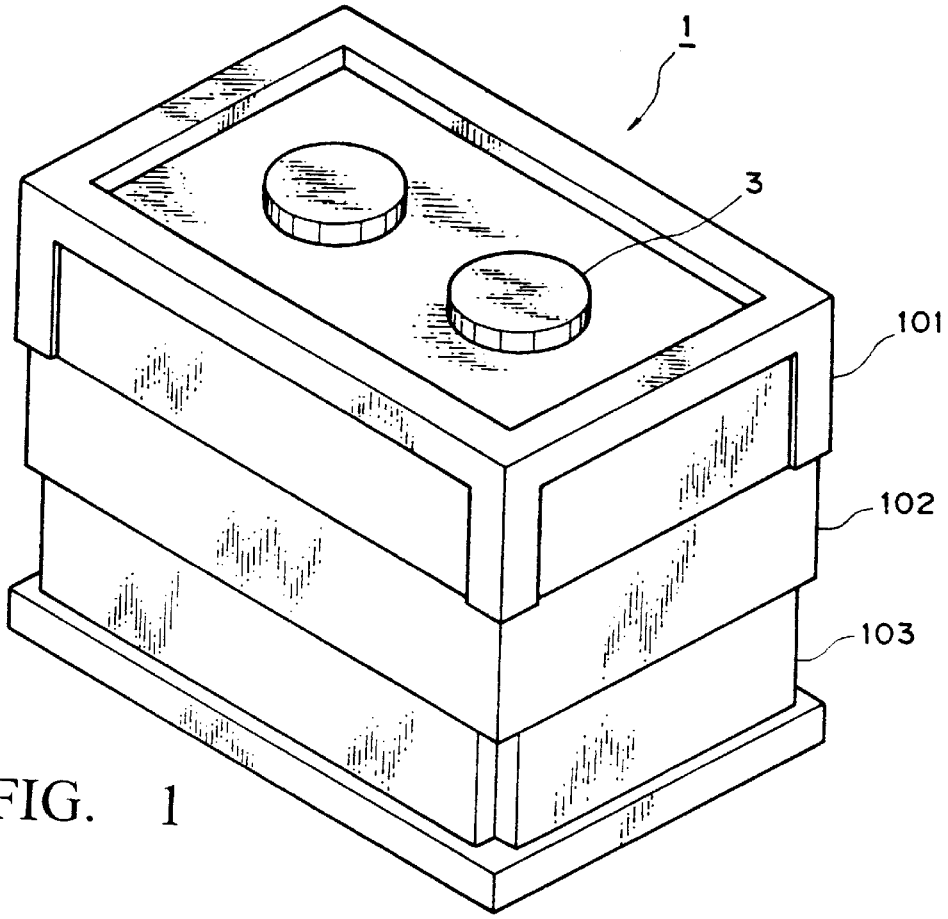
FIG. 1 is an oblique view of a cargo container in extended status according to the present invention.
Figure 2:
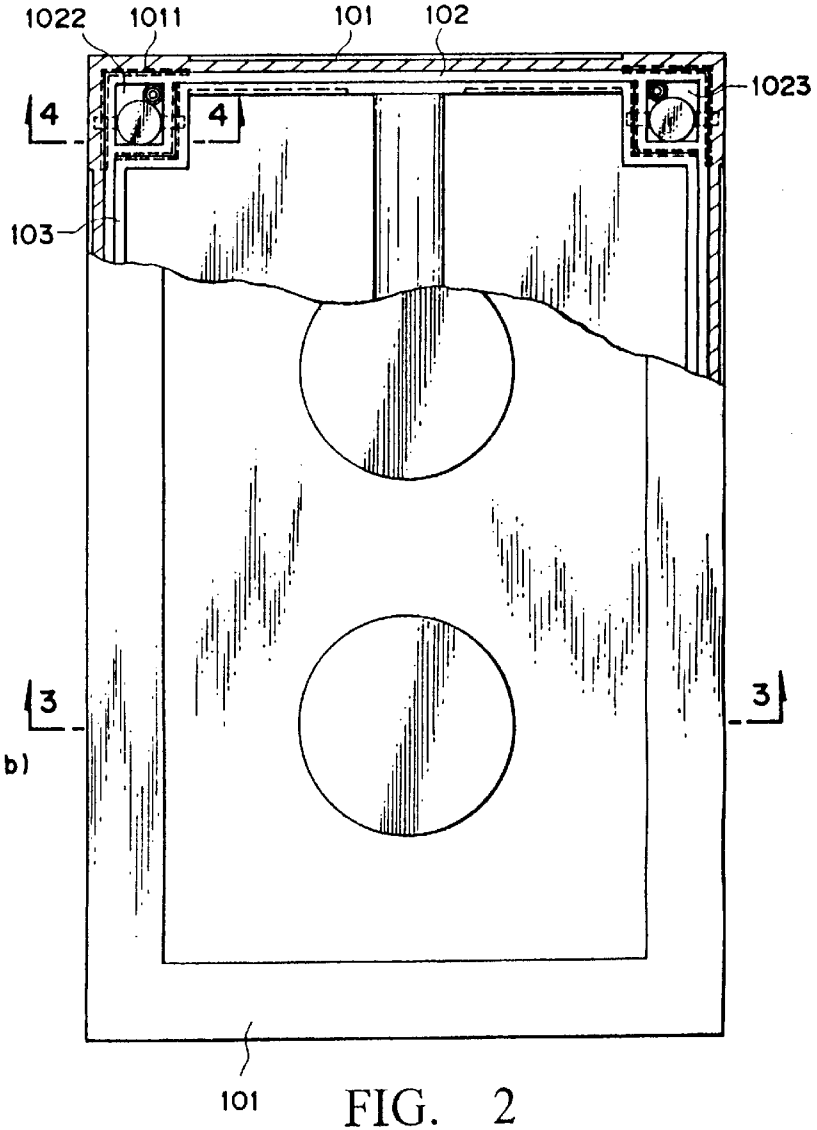
FIG. 2 is a top view of the cargo container in FIG. 1, wherein a part of the top side is shown in cutout.

First referring to FIGS. 1 and 2, the cargo container 1, according to the present invitation, comprises of an upper portion 101, a middle portion 102 and a lower portion 103. They are engaged with each other by means of sleeve joints. The outside diameter of the assembled cargo container is compatible to ISO standard and these three portions are a same height.

Figure 3:
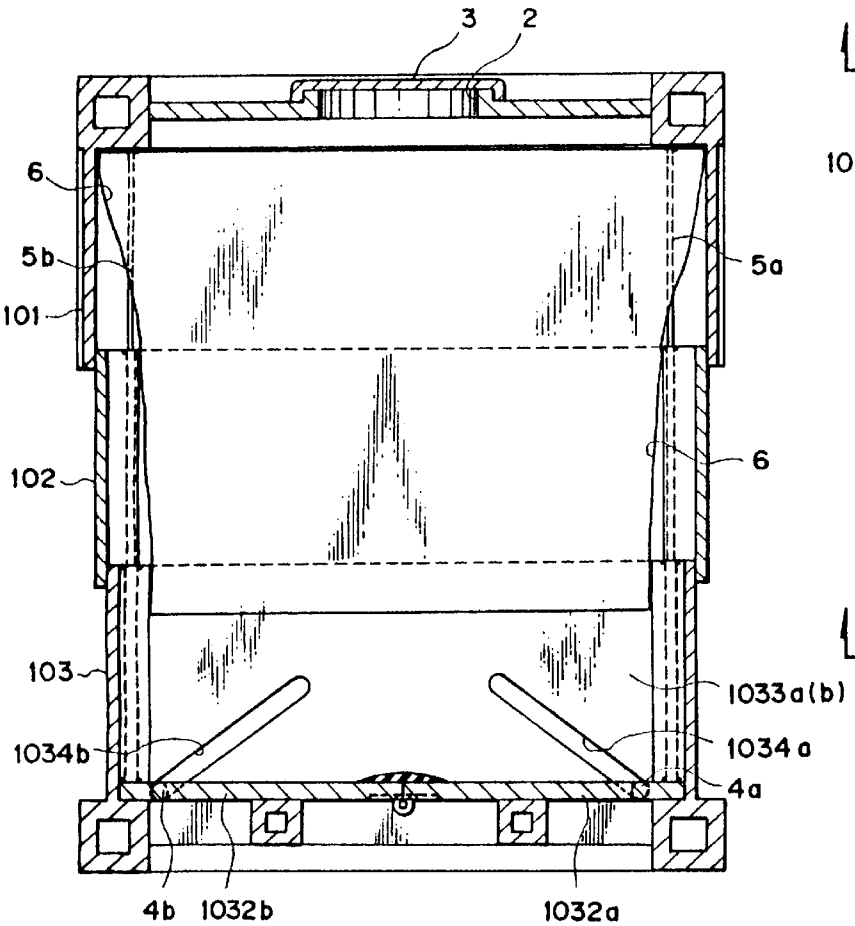
FIG. 3 is a cross sectional view taking along the line A—A in FIG. 2.
Figure 4:
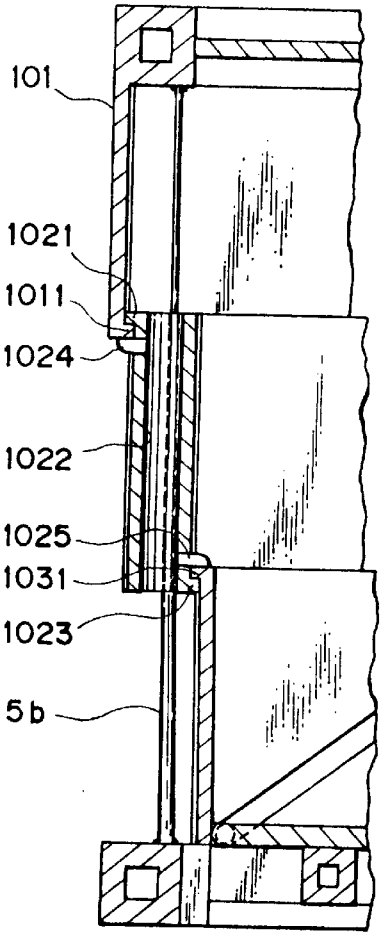
FIG. 4 is a cross sectional view taking along the line B—B in FIG. 2.

As shown in FIGS. 2 and 3, upper portion 101 is a rectangular body with a top end face. There are several loading holes 2 in the top end face for inputting materials and a same number of associated lids 3 used for covering the loading holes. The bottom end of the upper portion 101 is in a form of opening. Referring to FIGS. 2 and 4, at the locations of the four corner of the upper portion 101, a flange 1011 is projected horizontally inward from the internal end edge, which can be engaged with a flange 1021 located at the top end edge of the middle portion 102 which is sleeved into the upper portion 101, such as the upper portion 101 and the middle portion 102 are inseparable engaged securely.

The middle portion 102 which is sleeve jointed with the upper portion 101 has openings in both the top end and bottom end, and at the internal of the four corners thereof, each forms a square shaped space 1022, 1023 (not showing the other two corners) surrounded by walls. The two outside walls along the square shaped space 1022 form the above mentioned flange 1021 extending outward. In addition, the two inside walls at the bottom end of the square shaped space 1022, as shown in FIG. 4 form a flange 1023 protruding inward which can be engaged with horizontal flange 1031 or the bottom end of the lower portion 103, so that the middle portion 102 will not separated with the lower portion 103.

Referring again to FIG. 2, the lower portion 103 sleeve jointed into the middle portion 102 has opening in the top end and pivoted movable bottom plates in the bottom end. The four corners of the lower portion 103 recess inward fitting comparable with the four corner's outside forms of the middle portion 102, and the horizontal flange 1031 mentioned above is formed on the outside wall of these four corners. Further, as shown in FIG. 3, the lower portion 103 comprises two subplates 1032*a*, 1032*b* hinged connected with their closely opposite edges to form the bottom plate. On the other two far edges of the subplates 1032*a* and 1032*b*, two pivoted rollers 4*a*, 4*b* are respectively disposed on the opposite ends which can move along the oblique grooves 1034*a*, 1034*b* formed on the two front and rear side walls 1033*a*, 1033*b* of the lower portion 103 respectively.

Further referring to FIG. 3, in the upper portion 101, the middle portion 102 and the power portion 103 of the cargo container, the side walls form a rectangular space. A piece of soft pad which is waterproof and humidity proof is used to adhered on the inside peripheral of the rectangular shaped space formed by the surrounded side walls. This soft pad 6 has its top end edge adhering to inside flange of the upper portion 101 and at the middle location correspondent with internal flange of the top edge of the middle portion 102 of the cargo container, and the bottom end of the soft pad is adhered to the internal flange bottom edge of the lower portion 103 of the container box so that raining and humidity will not infiltrate into the container box via slits between the lapped location of the upper portion 101, middle portion 102 and lower portion 103. Upon the contraction mode or the cargo container as shown in FIG. 4, the soft pad can be overlapped on the location of sleeve connection as shown in FIG. 6.

Figure 5:
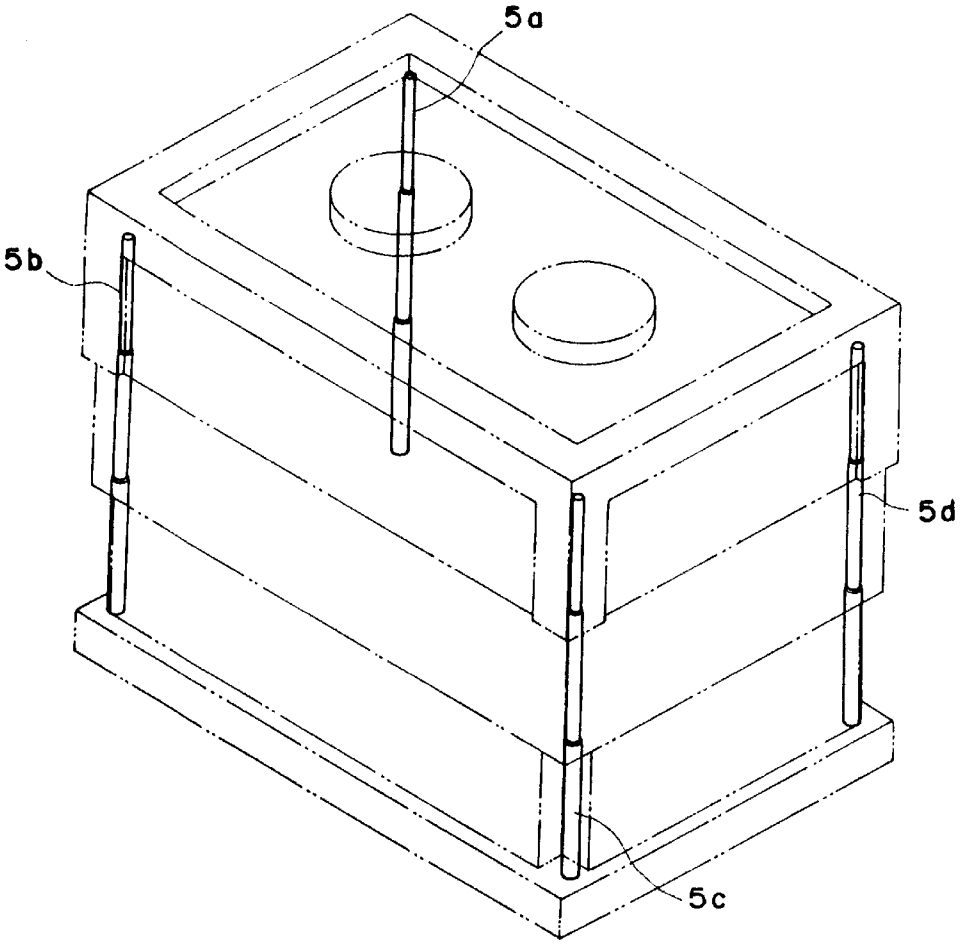
FIG. 5 is an oblique view of a cargo container in extended status according to the present invention, wherein the profile of outer part of the cargo container are represented by dotted lines and the support rods mechanism is represented by solid lines.

Finally, at the four corners of the cargo container 1, each is installed a multi-sectioned buffer bar 5*a*, 5*b*, 5*c* and 5*d* through the square shaped spaces 1022, 1023 or the middle portion 102 fixed to the upper portion 101 and lower portion 103 by its ends. The configuration is shown as FIGS. 4 and 5. The buffer bars have reversible air valve which are closed during the cargo container contraction, while the air is discharged slowly through the air hole to achieve the object of buffering. On the other hand, when the air valve is opening, the cargo contained will expanded rapidly.

Figure 6:
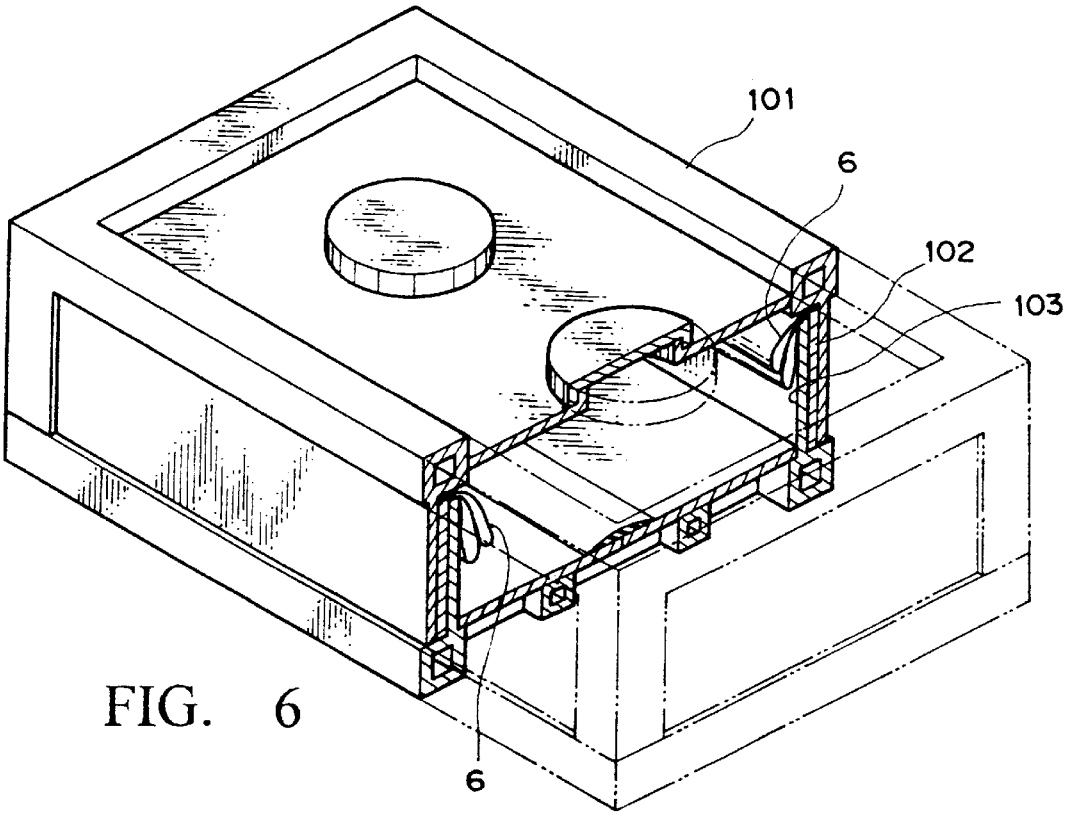
FIG. 6 is an oblique view of a cargo container in retracted status according to the present invention, wherein a part of the right end is shown in cutout.
Figure 7:
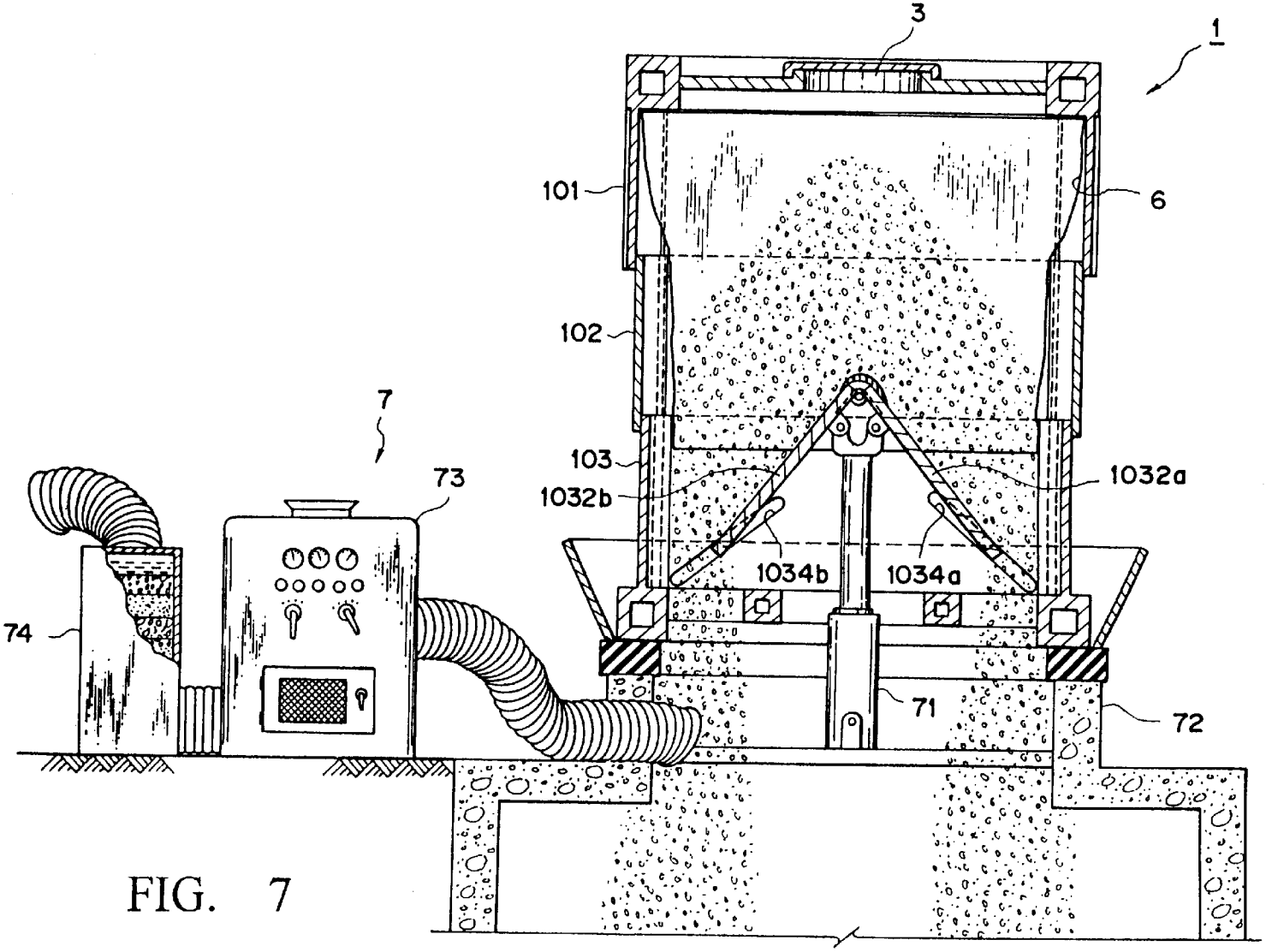
FIG. 7 is a schematic view of a cargo container in the status of discharging cargos according to the present invention, wherein two pieces of bottom side plates thereof are lifted up by an external force.

According to the present invention, the contracted cargo container as shown in FIG. 6 is used for explaining the operation of the invention. The cargo container constructed based on the present invention has a same profile and dimension as conventional cargo container. Therefore, the contracted cargo container is first lifted by a cane equipment in the container yard. Due to the weight of middle portion and lower portion of the cargo container, the middle portion land the lower portion begin to slide downward until the flange 1021 of the middle portion 102 stopped by the flange 1011 of the upper portion 101, and the flange 1031 of the lower portion 103 bloc by the lower flange 1023 of the middle 102. The cargo container is then self expanded completed. Therefore, two block means located in the square shaped space 1022, 1023 of the middle portion 102 at the top and bottom ends thereof are enabled by the operator to cause the block stops 1024, 1025 (shown in FIG. 4) protruding to the outside of the walls of the square space and located respectively under the flange 1021 and on the flange 1031 for holding the container box in the expanded condition to be moved to other place by the crane for the use of loading cargos, The respective block means is comprised of the conventional magnetic valves and the block stop are a part of plug columns, When the expanded cargo container has loaded with materials via the input holes 2 and is transported by a cargo carrier in sea or a container trailer in land until it arrives at the terminal. The procedure of discharging the materials can use a procedure of discharging materials from bottom of the cargo container by a process disclosed in R.O.C. Taiwan Patent No. 71952 "The Method and Practical Means for Discharging Materials by Gravity from the Cargo Container with an Openable Two Bottom Subplates" by the same inventor. FIG. 7 shows that practical means provided by the patent, in that, the cargo container is positioned on a discharge station or a discharge tank 72. Consequently, a moving force, such as from a jack is used to push on the mid section of the pivot jointed subplates 1032*a*, 1032*b* upward. Then the two side edges of the subplates 1032*a*, 1032*b* will follow the raise of the mid section to move upward gradually along the guide grooves 1032*a*, 1032*b* and two openings will also appear near the side edges. Therefore, the materials in the cargo container will follow two slant subplates to slide out of the cargo container to enter the discharge station 72. During material discharging, a dust collector 73 is provided to suck a great deal of dust powders from time to time out of the sealed discharging tank 72 entering into a water tank 74 through a filter. So that, no time is wasted for quickly lifting the empty cargo container which has just completed the discharge. It is unnecessary to worry about the dust powders from escaping outside of the container tank 72 to contaminate the ambient environment.

After the materials have been discharged completely, the cargo container is lifted away by the crane equipment and the block means is operated through an electrical means or operated by a linking bar manually to withdraw the block stops, the upper portion and the middle portion of the cargo container then will slide downward by their own weights, while the buffer rods slow the change to result a retracted status as FIG. 6 shown. Its dimension is now reduced to one third of its original size, and the retracted cargo container from three portions can be locked into one unit by lock elements placed at the four corners. Each unit of the container box can be piled up as the conventional container box door, then to be transported to other places for the use of loading materials.

Summing up the above description, the present invention allows the idle cargo containers to retract for transport or storage, and it can rapidly stretch out for loading materials. The present invention is deemed to be an advanced and inovatory invention.

What I claimed is:

1. An extensible and retractable cargo container comprising an upper portion, a middle portion and a lower portion engaged with each other together by sleeve joints, wherein:

said upper portion has a top end face and a bottom end in a form of opening, in said top end face, a number of input holes beings made as material input holes and at the four corners of the bottom end opening, a flange being formed inward projected horizontally;

said middle portion is sleeve jointed into said upper portion and has openings in both top and bottom ends, at the inner sides of the four corners thereof each forms a square shaped space surrounded by walls, at the top end of said square shaped space and on the outside wall between two adjoining rectangular corners, a horizontal flange being disposed outward to engage on top of the flange of the upper portion, at the bottom end of said square shaped space and on the outside wall between two adjoining rectangular corners, a horizontal flange being also disposed inward; and said lower portion has opening at top end and recessed four corners to fit the shape of the four corners of the four corners of the middle portion in order to be sleeve jointed into the internal of the middle portion, at the outer walls and on the top of the four corners, a projected flange being formed outward to engaged on the bottom end flange of the middle portion, therein, the bottom end having a bottom plate formed by two pivot connected subplates, at the far ends of these two subplates, each disposed with a pivoted rollers which can move along the slantwise rising grooves on the front and rear side walls of the lower portion.

2. The extensible and retractable cargo container according to claim 1, further comprising a plurality of block mechanisms installed on said top and bottom ends of the square shaped spaces of the middle portion, when said upper portion, said middle portion and said lower portion are in extended condition, the block stops in said block mechanisms being controllable to protrude the outside walls of the middle portion, and positioned under the flange of the upper portion and projected on and under the flange of the lower portion to hold the extensible conditions of the upper portion, the middle portion and the lower portion.

3. The extensible and retractable cargo container according to claim 1, wherein said square shaped space of the middle portion has a multi-sectioned buffer rod positioned therein.

4. The extensible and retractable cargo container according to claim 1, wherein said side walls of the cargo container form a rectangular space and a soft pad therein is attached on the inside of said side walls.

* * * * *

UNITED STATES PATENT AND TRADEMARK OFFICE

CERTIFICATE OF CORRECTION

PATENT NO. : 5,878,903
DATED : March 9,1999
INVENTOR(S) : Lu-Hsiung Ung

It is certified that error appears in the above-identified patent and that said Letters Patent is hereby corrected as shown below:

Column 2, line 3, delete "A—A" and substitute therefor --3 – 3--.

Signed and Sealed this

First Day of June, 1999

*Attest:*

Q. TODD DICKINSON

*Attesting Officer*

*Acting Commissioner of Patents and Trademarks*